US005333421A

United States Patent [19]

McKenna

[11] Patent Number: 5,333,421

[45] Date of Patent: Aug. 2, 1994

[54] HOUSING UNIT

[76] Inventor: John T. McKenna, 352 Atlantic Ave., Clayton, N.J. 08312

[21] Appl. No.: 87,515

[22] Filed: Jul. 9, 1993

[51] Int. Cl.[5] ..... E04B 1/32

[52] U.S. Cl. ..... 52/86; 52/63

[58] Field of Search ..... 52/63, 86, 584.1, 602, 52/270, 802, 803; 135/101, 102, 116

[56] References Cited

U.S. PATENT DOCUMENTS

| | | | |
|---|---|---|---|
| 2,328,197 | 8/1943 | Cowin | 52/86 |
| 2,565,746 | 8/1951 | Turner | 135/101 X |
| 2,666,507 | 1/1954 | Ryark | 52/86 X |
| 2,717,160 | 9/1955 | Schmidt et al. | 280/20 |
| 3,114,377 | 12/1963 | Clement | 135/3 |
| 3,749,107 | 7/1973 | Laberge | 135/1 |
| 3,755,975 | 9/1973 | Herzer et al. | 52/86 X |
| 3,812,616 | 5/1974 | Koziol | 52/63 |
| 3,897,622 | 8/1975 | Utaharn | 52/86 X |
| 3,930,344 | 1/1976 | Gahler | 52/63 X |
| 4,068,421 | 1/1978 | Marovich | 52/86 X |
| 4,068,423 | 1/1978 | Marsh | 52/86 |
| 4,091,584 | 5/1978 | Brown | 52/86 |
| 4,347,690 | 9/1982 | Wallace, Jr. | 52/86 X |
| 4,501,103 | 2/1985 | Markey et al. | 52/745 |
| 4,700,514 | 10/1987 | Reineman | 52/86 |
| 4,723,386 | 2/1988 | Sandow | 52/86 X |
| 4,831,793 | 5/1989 | Galloway et al. | 52/86 |
| 5,033,493 | 7/1991 | Senchuck | 135/113 |

FOREIGN PATENT DOCUMENTS

| | | | |
|---|---|---|---|
| 2820508 | 11/1979 | Fed. Rep. of Germany | 52/86 |
| 540881 | 3/1940 | United Kingdom | 52/86 |

OTHER PUBLICATIONS

Brochure by Polygal, USA.

*Primary Examiner*—Carl D. Friedman
*Assistant Examiner*—Creighton Smith
*Attorney, Agent, or Firm*—Thomas A. Lennox

[57] ABSTRACT

A quonset type hut house unit includes a skeletal structure of a pair of "L" frame lengthwise base members with a multiplicity of vertical tubular members with an open top and bottom with a multiplicity of preformed steel arch shaped rib members with ends engaged in the vertical tubular members, end walls of reinforced plastic sections coupled together and to the skeletal structure through inwardly extending flanges and a cover sheet formed of a plurality of structured integral panels that include two face sheets spaced apart by a multiplicity of webs bent over the rib members and attached to the skeletal frame.

14 Claims, 4 Drawing Sheets

HOUSING UNIT

BACKGROUND OF THE INVENTION

This invention involves a housing unit and more specifically a quonset hut type construction in the form of a semi-permanent structure.

Small semi-permanent housing units usually not set on a foundation are popular to add storage space, to act as a greenhouse or a detached work area. Miniature barns constructed out of wood are popular but must be constructed very carefully or leaks, structural failures, or other problems arise. Greenhouse type structures have been constructed in the form of quonset huts utilizing thin plastic film spread over a skeletal structure. This type of structure does not have to be absolutely water tight and is only semi-permanent in that the plastic film shortly degrades and must be replaced. The end structures of such houses vary greatly and commonly are constructed out of metal framing or standard wood. There is a substantial need to provide a durable semi-permanent structure that can be utilized for a variety of end uses and that can easily be adjusted as to the size of the floor plan.

U.S. Pat. No. 3,749,107 to Laberge describes a collapsible garage with lower channel members into which fits the ends of arch shaped structural members over which a flexible top covering is spread. U.S. Pat. No. 4,068,423 to Marsh describes a greenhouse structure suitable for field assembly utilizing an arch supported roof covered with corrugated plastic with one piece end walls. U.S. Pat. No. 4,501,103 to Markey et al describes a building construction and purlin hanger for a frame constructed house. U.S. Pat. No. 2,717,160 to Schmidt et al describes a fishing shelter using a base frame into which a hanging frame interfits. U.S. Pat. No. 3,114,377 to Clement describes a set up tent with a peripheral frame into which upright support members engage. U.S. Pat. No. 5,033,493 to Senchuck describes a collapsible utility shack with one piece end panels on a skeletal frame that collapses. U.S. Pat. No. 4,831,793 to Galloway et al describes a greenhouse with a skeletal structure formed by interlocking cross members. U.S. Pat. No. 4,091,584 to Brown describes a building structure utilizing PVC tubing covered with a fabric or corrugated sheet.

None of these devices satisfy the above needs nor attain the objects described hereinbelow.

SUMMARY OF THE INVENTION

It is an object of the present invention to provide a housing unit that is weather tight and structurally sound.

It is an additional object of the present invention to provide a housing unit that can be easily constructed in the field using common tools and minimum man power.

It is a further object of the present invention to provide a housing unit that is adjustable as to size of the floor plan by adjustment of the width to provide a variety of combinations of end walls. It is a further object of the present invention to provide a housing unit that is virtually unlimited as to its length.

It is an additional object of the present invention to provide a housing unit that offers great versatility from use as a greenhouse, to an actual residential structure varying the light transmission through the top and sides of the structure from essentially transparent to opaque.

Throughout the specification, the term "composite" is utilized to include fiber, such as glass fiber, reinforced structures molded to form the integral wall sections that make up the end walls. Although a unit with end walls constructed of three-wall sections, a key element of this invention is the versatility of the number of the wall sections that may be utilized. If a smaller unit is desired, the center section may be removed leaving a solid end wall constructed of the two sections. On the other hand, if a wider unit is desired, an additional center section can be easily included as the upper edge of the center section may be nearly horizontal allowing the flexible arch shaped rib members to conform to the shape of the end wall edge.

An aspect of the invention is a house unit that includes two ends and a length along two sides. The unit includes a skeletal structure that includes a pair of longitudinal base members aligned lengthwise along each side of the unit, wherein each longitudinal base member includes an upstanding section along its length. The skeletal structure further includes a multiplicity of vertical tubular members attached to the upstanding section of the longitudinal base members at intervals spaced apart along the length of the longitudinal base members, each vertical tubular member that includes an open top and an open bottom, wherein the vertical tubular members are spaced apart forming complementary pairs across from each other laterally positioned equidistant along the length of opposite longitudinal base members. The skeletal structure further includes a multiplicity of arch shaped rib members each having one end inserted in an open top of a first vertical tubular member and an opposite end inserted in an open top of a second vertical tubular member that is paired with the first vertical tubular member. The housing unit further includes two vertical end walls each having a bottom edge and an arch shaped side and top edge. Each end wall includes a plurality of integral composite wall sections and each wall section includes an outside surface facing outwardly, an inside surface facing inwardly, and a peripheral edge. Each wall section further includes a peripheral flange extending inwardly from the peripheral edge, wherein the peripheral flange includes at least one vertical section when the composite wall section is disposed vertically. Each end wall further includes attachment means to attach adjacent vertical sections of juxtaposed composite wall sections. The housing unit further includes connection means to connect the end walls to two arch shaped ribs positioned proximate opposite ends of the unit. The housing unit also includes a flexible sheet bent in an arch shape to conform against the rib members, the sheet including two first edges of a length proximate that of the base members and a width proximate the length of the arch shaped rib members. The housing unit further includes holding means to attach the first edges of the flexible sheet to the skeletal frame proximate opposite base members.

It is preferred that the skeletal structure further include a pair of longitudinal purlin support members aligned lengthwise along each side of the unit attached to an inside surface of the rib members at a height above each longitudinal base member. It is further preferred that the skeletal structure further include a top purlin support member aligned lengthwise along each side of the unit attached to an inside surface of the rib members at an uppermost height. It is also preferred that the longitudinal base members be "L" shaped cross sectioned members and the upstanding section be one side of the "L" shape. It is further preferred that the vertical tubular members be welded to the upstanding section of the longitudinal base members positioning the open bottom proximate a horizontal section of the longitudinal base members. It is also preferred that the vertical tubular members be welded to the upstanding section of the longitudinal base members positioning the open bottom proximate a lower horizontal section of the longitudinal base members. It is further preferred that the flexible sheet bent in an arch shape to conform against the rib members be an extruded thermoplastic polymer structured integral panel that includes two face sheets spaced apart by a multiplicity of webs joining the face sheets, the webs being aligned to bend over the rib members. It is also preferred that the unit further include foundation means to support the unit that includes a frame of treated wood planks attached to the longitudinal base members. It is further preferred that the holding means to attach the first edges of the flexible sheet to the skeletal frame includes bolts through oversize holes in the flexible sheet aligned with horizontal holes through the longitudinal base members, the rib members, and the vertical tubular members. It is also preferred that the connection means to connect the end walls to two arch shaped ribs positioned proximate opposite ends of the unit include bolts through oversize holes in the flexible sheet aligned with holes through an upper section of the peripheral flange extending inwardly from the end wall sections and the rib members.

Another aspect of the invention is a house unit that includes two ends and a length along two sides. The unit further includes a skeletal structure that includes a pair of "L" shaped cross sectioned longitudinal base members aligned lengthwise along each side of the unit, wherein one side of the "L" shape of each longitudinal base member is upstanding along an outside lower edge of the unit and a remaining side of the "L" shape positioned horizontally extending inwardly to the unit. The skeletal structure further includes a multiplicity of vertical tubular members each including an open top and an open bottom, each vertical tubular member welded to the upstanding side of the longitudinal base members at intervals spaced apart along the length of the longitudinal base members positioning the open bottom proximate the remaining side of the longitudinal base members, wherein the vertical tubular members are spaced apart forming complementary pairs across from each other laterally positioned equidistant along the length of opposite longitudinal base members. The skeletal structure further includes a multiplicity of arch shaped rib members each having one end inserted in an open top of a first vertical tubular member and an opposite end inserted in an open top of a second vertical tubular member that is paired with the first vertical tubular member. The skeletal structure further includes a pair of longitudinal purlin support members aligned lengthwise along each side of the unit attached to an inside surface of the rib members at a height above each longitudinal base member, and a top purlin support member aligned lengthwise along each side of the unit attached to an inside surface of the rib members at an uppermost height. The unit further includes two vertical end walls each having a bottom edge and an arch shaped side and top edge. Each end wall includes a plurality of integral composite wall sections. Each wall section includes an outside surface facing outwardly, an inside surface facing inwardly, a peripheral edge, and a peripheral flange extending inwardly from the peripheral edge, wherein the peripheral flange includes at least one vertical section when the composite wall section is disposed vertically. Each wall section includes attachment means to attach adjacent vertical sections of juxtaposed composite wall sections. The unit further includes connection means to connect the end walls to two arch shaped ribs positioned proximate opposite ends of the unit. The unit further includes a flexible sheet bent in an arch shape to conform against the rib members, the flexible sheet including a plurality of extruded thermoplastic polymer structured integral panels that each include two face sheets spaced apart by a multiplicity of webs joining the face sheets, the webs being aligned to bend over the rib members. The flexible sheet includes two first edges of a length proximate that of the base members and width proximate the length of the arch shaped rib members. The unit further includes holding means to attach the first edges of the flexible sheet to the skeletal frame proximate opposite members.

DESCRIPTION OF PREFERRED EMBODIMENTS

Figure 1:
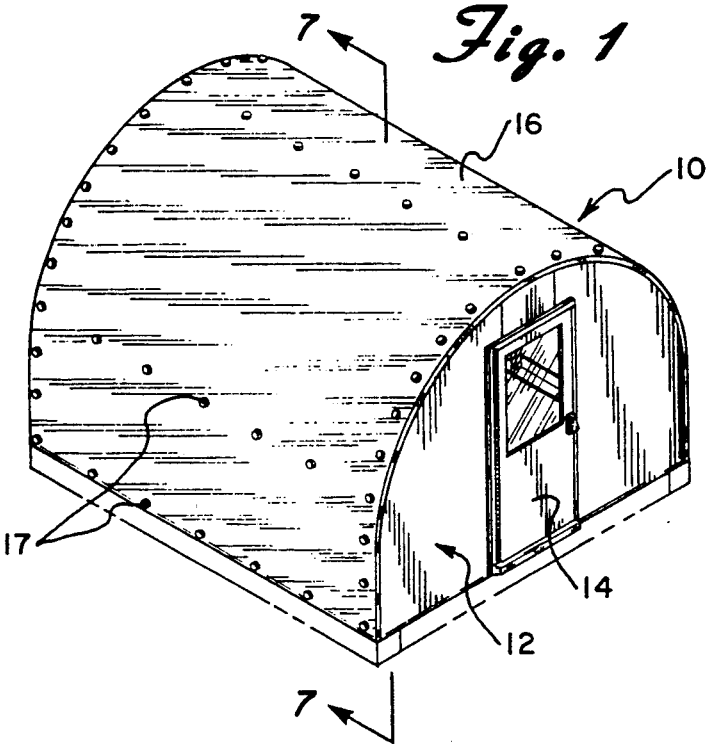
FIG. 1 is a perspective view of a housing unit of the present invention.
Figure 3:
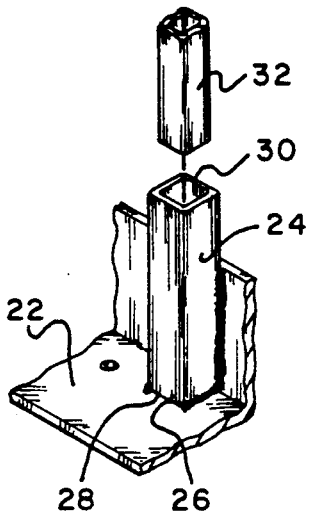
FIG. 3 is an enlarged partially cut away perspective view of a connecting section viewed along lines 3—3 of FIG. 2.
Figure 2:
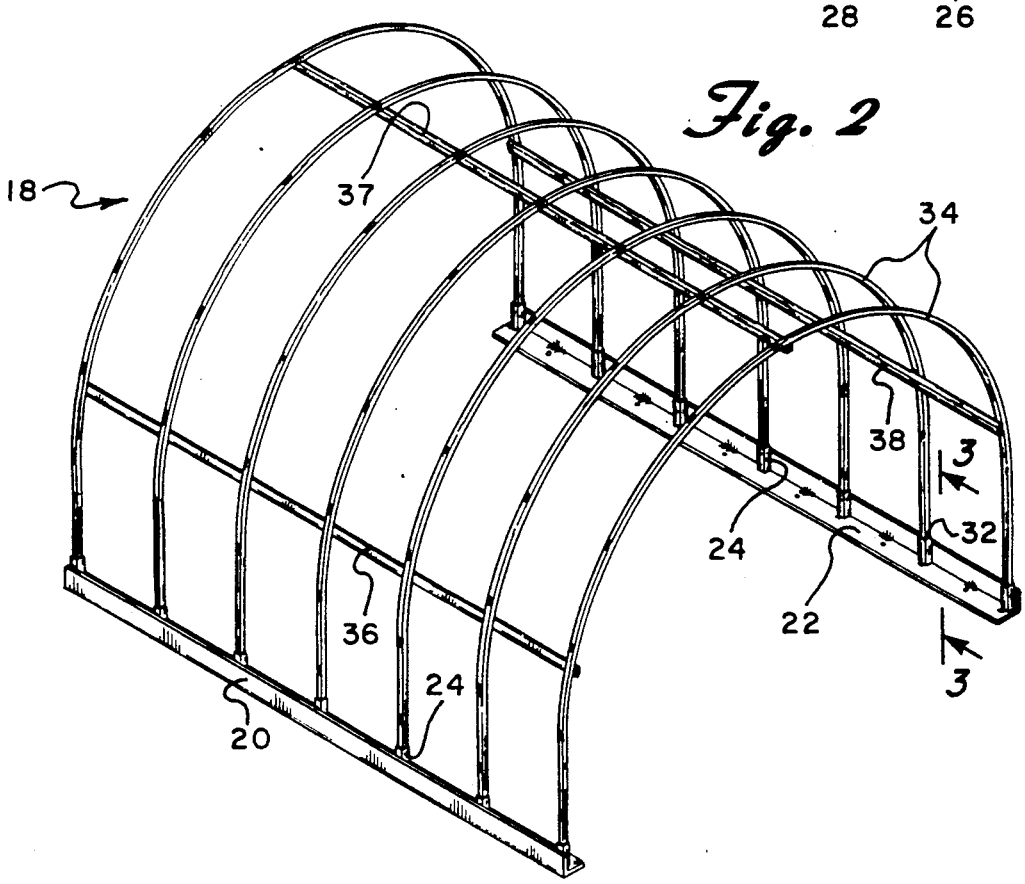
FIG. 2 is a perspective view of the skeletal structure thereof with the end walls and roof cover sheet removed.
Figure 4:
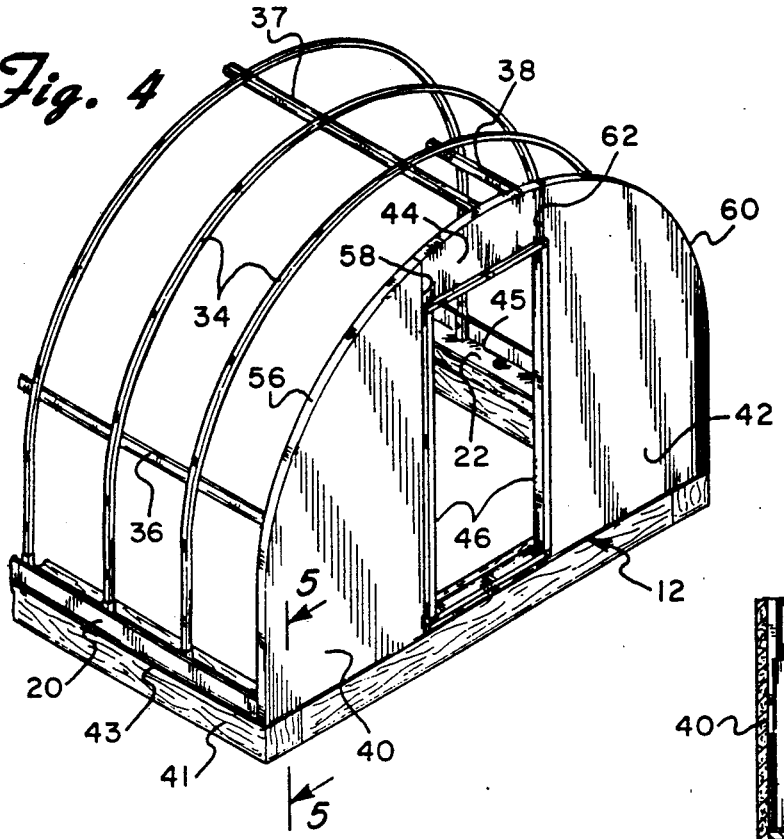
FIG. 4 is a perspective view thereof partially cut away with the end wall added to the skeletal frame.
Figure 5:
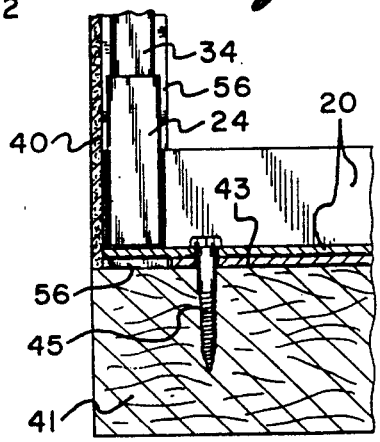
FIG. 5 is a partially cut away cross-sectional view taken along line 5—5 of FIG. 4.
Figure 6:
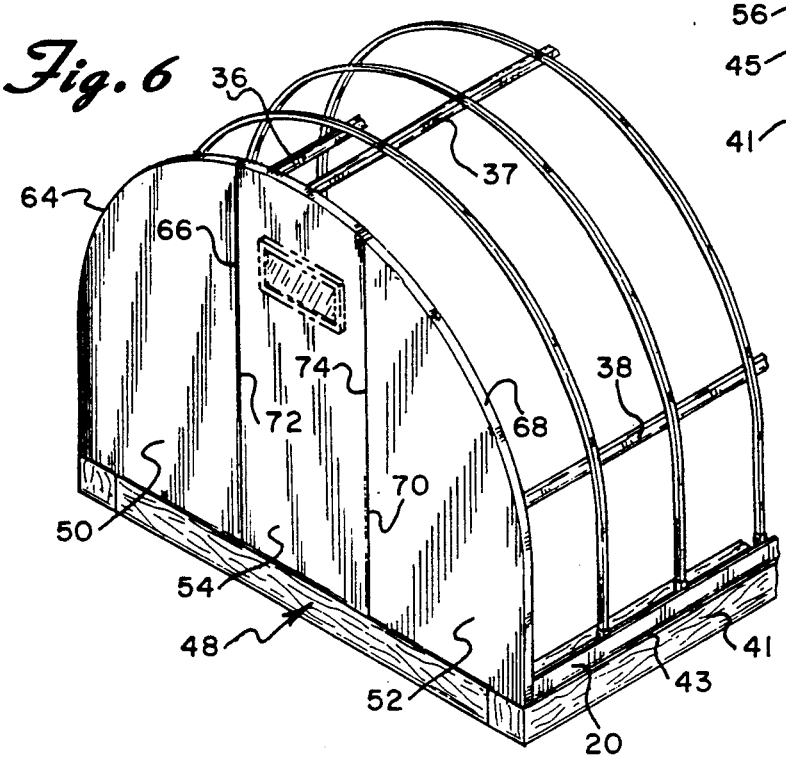
FIG. 6 is a rear perspective view thereof partially cut away with the rear end wall connected to the skeletal frame.
Figure 7:
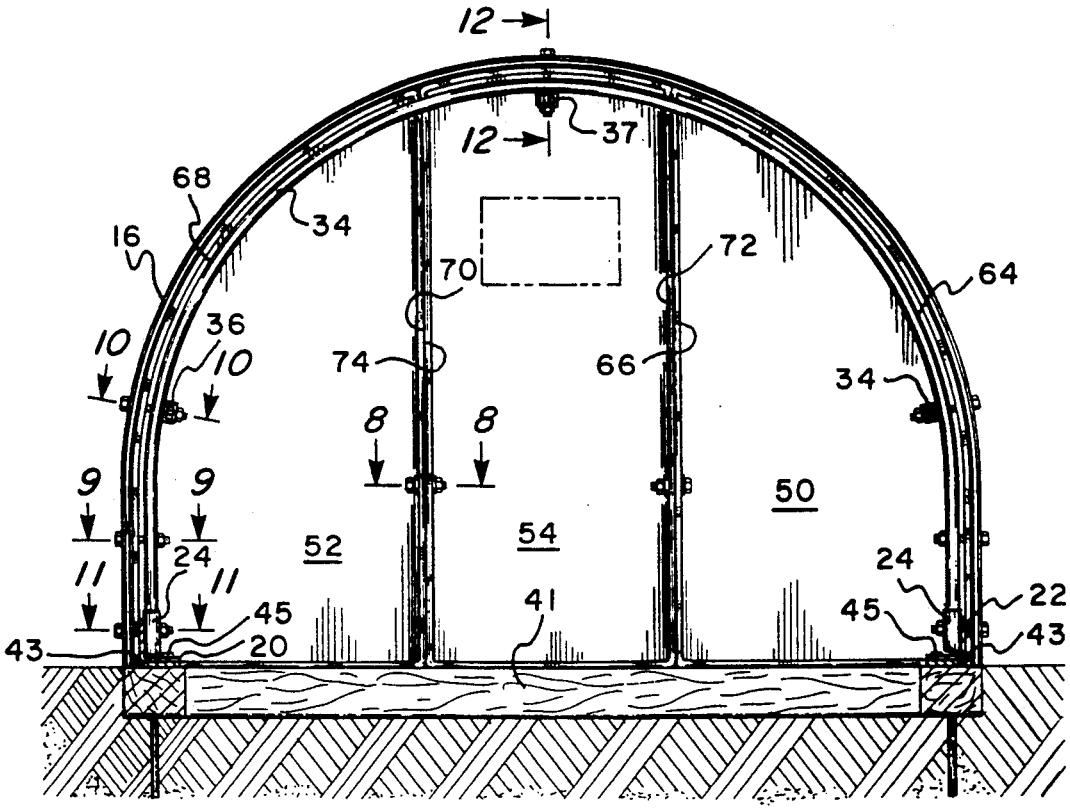
FIG. 7 is a cross-sectional view taken along lines 7—7 of FIG. 1.
Figure 8:
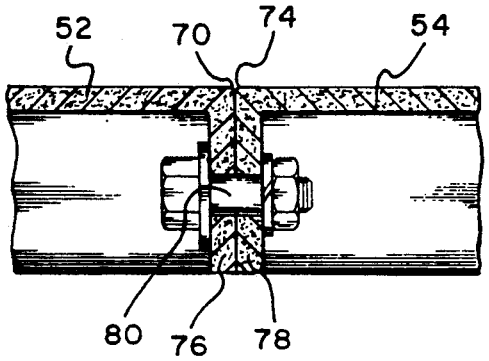
FIG. 8 is a partially cut away cross-sectional view taken along lines 8—8 of FIG. 7.
Figure 9:
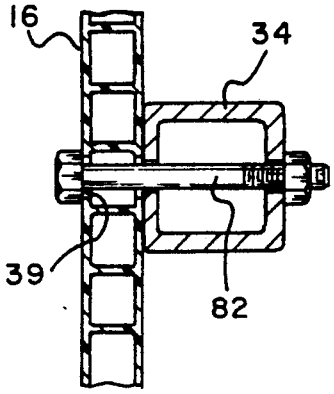
FIG. 9 is a partially cut away cross-sectional view taken along lines 0—9 of FIG. 7.
Figure 10:
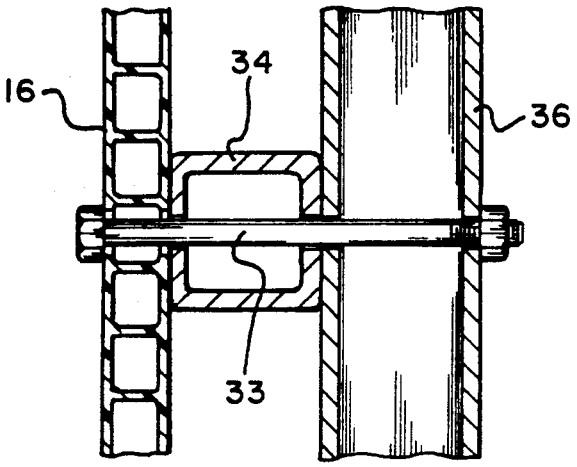
FIG. 10 is a partially cut away cross-sectional view taken along lines 10—10 of FIG. 7.
Figure 11:
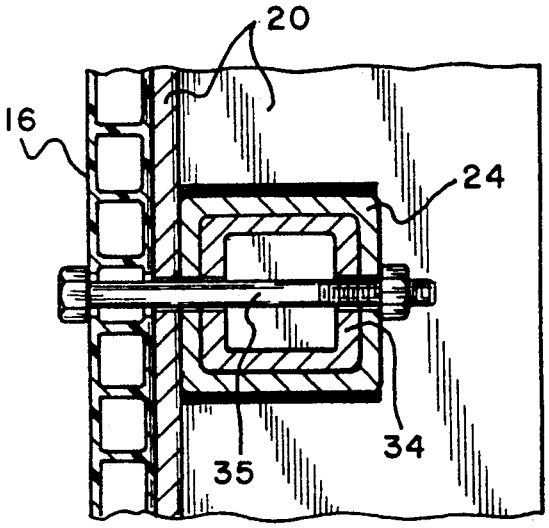
FIG. 11 is a partially cut away cross-sectional view taken along lines 11—11 of FIG. 7.
Figure 12:
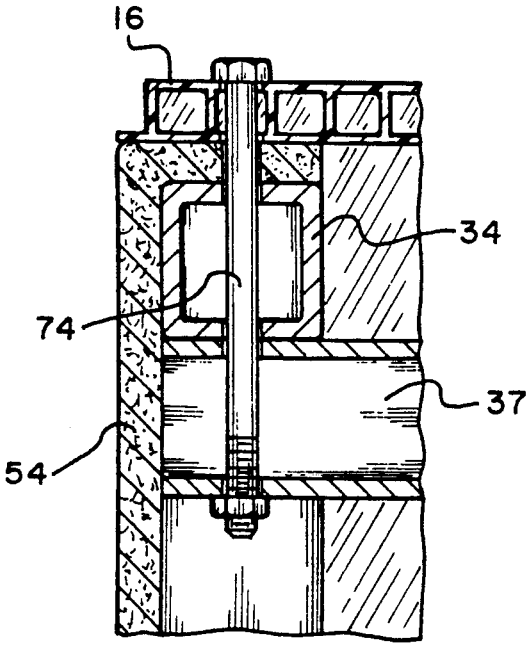
FIG. 12 is a partially cut away cross-sectional view taken along lines 12—12 of FIG. 7.

Housing unit 10 is illustrated in FIG. 1 with the balance of FIGS. 2 through 8 showing cut away and cross-sectional structural views thereof. Unit 10 is constructed of front end wall 12 through which door 14 is framed. Cover sheet 16 is constructed of panels of Polygal® polycarbonate structured sheet supplied and marketed by Polygal, USA, P.O. Box 1567, Ganesville, Wis. 53547 fastened together at seams along the length of unit 10 with extruded polycarbonate snap together fastening strips clipped together supplied by Polygal, USA. The structured sheets are extruded moldings of polycarbonate resin supplied in stock widths of four or six feet supplied in any practical length. The integral extruded structured sheet is composed of two face sheets spaced apart about one-quarter to five-eighths inch, with lengthwise webs extending the length of the extrusion forming a multiplicity of passages from end to end of the sheets. The Polygal® sheet is available in various tints as well in an RFX TM solar controlled glazing construction to aid in screening out summer solar heat. The brochure supplied by Polygal, USA describing the specifications of the material is incorporated herein by reference thereto. Other cover material such as corrugated glass fiber reinforced plastic panels, various films, as well as other composite panels may be used as the cover sheet. In FIG. 2, with sheet 16 and the end walls removed, skeletal frame 18 is constructed of a pair of longitudinal base frame members 20 and 22 each constructed of two and one-half inch one-quarter inch thick galvanized steel angle although aluminum is also satisfactory. As shown in FIG. 3, the ends of arch rib members 34, constructed of one inch square sixteen gauge galvanized steel tubes are connected into the base frame members. At twenty inch intervals along the length of members 20 and 22 are welded six inch high one and one-quarter inch square tubing members 24 with bottom ends 26 welded leaving bottom opening 28 for drainage. Unobstructed top opening 30 opens upwardly to receive ends 32 of performed steel arch shaped ribbed members 34. Intermediate horizontal purlin support member 36 and 38 constructed of one inch square steel tubing are bolted at median positions up the sides of rib members 34. Top purlin horizontal support member 37 is also constructed of one inch square steel tubing bolted on the inside of rib members 34. All connections of the purlin members are connected through sheet 16 forming an integral unit. Further, bolt connections proximate the end walls connect through cover sheets 16, the flanges of the composite end wall sections, the rib end member 34 nestled inside the arched edge flange of the end wall sections and the end of the purlin horizontal support member as shown in FIG. 5*a*. As shown in FIGS. 4 and 5, and as further illustrated in FIG. 4*a*, the "foundation " of unit 10 is temporary but secure as constructed of four by four inch pressure treated wood frame set in the ground with the top surface flush with the ground surface. Members 20 and 22 are attached to wood foundation frame 41 through lag bolts 45 on one foot centers along the entire length. Since the bottom flange of the composite sections, such as section 40 shown in FIG. 4*a*, extends under the end of base member 20, one-quarter inch aluminum strip spacer 43 is used between member 20 and the wood foundation to reduce any undo strain on the flange and to provide a level bearing surface. As further shown in FIGS. 4 and 5, front end wall 12 and rear end wall 48 are each constructed of three separate integral composite wall sections, each constructed individually of marine type glass fiber reinforced unsaturated polyester resin laminates. The exterior surface is glass fiber reinforced highly pigmented gel cost cured against a smooth surface mold. Front end wall 12 is constructed of left front section 40 with arced curved edge 56 and right vertical edge 58. Right front section 42 is a mirror image duplicate of section 40 with right arch edge 60 and left vertical edge 62. Middle section 44 connects the other end sections with its vertical edges abutting and connecting to vertical edges 58 and 62 of the adjacent sections above door frame 46. Rear wall 48 is constructed of left section 50, right section 52, and center section 54. Left section has left arch edge 64 and right vertical edge 66 while its mirror image counterpart, right section 52, has right arch edge 68 and left vertical edge 70. Center section 50 has two straight vertical edges, left edge 72 and right edge 74 which abut to and are connected to vertical edges 66 and 70 respectively as diagrammed in FIGS. 6 and 7. Each arched edge has an inwardly directed flange, each vertical edge has an inwardly directed flange, each bottom horizontal edge has an inwardly directing flange. These flanges are continuous around the entire peripheral edge of each section except for small cutouts at the top intersections of the vertical edges to allow nesting of the end arch members 34 inside the flange. That two inch flange is used to connect the sections together to form the end walls and to connect to arch rib members 34 that are positioned proximate the ends of skeletal frame 18. As shown in FIG. 7, edge 70 of section 52 and edge 74 of section 54 are abutted against each other. Flange 76 extends two inches inwardly from edge 70 and flange 78 extends two inches inwardly from edge 74. Bolt and nut combination 80 extends through horizontal holes aligned through flanges 76 and 78 to join the sections together. While only one bolt 80 is shown, a multiplicity of bolt and nut combinations are positioned along the length of the abutted vertical flanges to allow easy construction of the end walls. As shown in FIG. 8, roof sheet 16 is attached through bolt and nut combination 82 through holes through rib members 34. In FIG. 5*a*, bolt and nut combination 74 provides connection between major components, cover sheet 16, composite flange of section 54, a median top point of arched rib member 34 and the end of purlin 37. The cross-sectional cutaway view of FIG. 8*a* is of the connection at a lower edge in a median position along the length of base members 20 and 22. At this juncture, connection through bolt and nut combination 35 is through cover sheet 16, base member 20, vertical tube member 24 and end 32 of a rib member 34. The hole through the vertical section of base member 20 is positioned about two inches high to provide as much length of cover sheet material 16 past the holes 39 that are oversized to allow for expansion and contraction. Expanded cross-sectional cutaway view 8*c* is one of a multiplicity of connections through purlin 36 spaced on twenty inch centers along both sides of the structure. Bolt and nut combination connects through cover sheet 16, a rib member 34 and purlin While this invention has been described with reference to the specific embodiments disclosed herein, it is not confined to the details set forth and the patent is intended to include modifications and changes which may come within and extend from the following claims.

I claim:

1. A house unit comprising two ends and a length along two sides, the unit comprising:

(A) a skeletal structure comprising:

(i) a pair of longitudinal base members aligned lengthwise along each side of the unit, wherein each longitudinal base member comprises an upstanding section along its length, (ii) a multiplicity of vertical tubular members attached to the upstanding section of the longitudinal base members at intervals spaced apart along the length of the longitudinal base members, each vertical tubular member comprising an open top and an open bottom, wherein the vertical tubular members are spaced apart forming complementary pairs across from each other laterally positioned equidistant along the length of opposite longitudinal base members, and (iii) a multiplicity of arch shaped rib members each having one end inserted in an open top of a first vertical tubular member and an opposite end inserted in an open top of a second vertical tubular member that is paired with the first vertical tubular member, (B) two vertical end walls each having a bottom edge and an arch shaped side and top edge, each end wall comprising:

(i) a plurality of integral composite wall sections each comprising:

(a) an outside surface facing outwardly, an inside surface facing inwardly, and a peripheral edge, and (b) a peripheral flange extending inwardly from the peripheral edge, wherein the peripheral flange comprises at least one vertical section when the composite wall section is disposed vertically, and (ii) attachment means to attach adjacent vertical sections of juxtaposed composite wall sections, (C) connection means to connect the end walls to two arch shaped ribs positioned proximate opposite ends of the unit, (D) a flexible sheet bent in an arch shape to conform against the rib members, the sheet comprising two first edges of a length proximate that of the base members and a width proximate the length of the arch shaped rib members, and (E) holding means to attach the first edges of the flexible sheet to the skeletal frame proximate opposite base members.

2. The unit of claim 1 wherein the skeletal structure further comprises a pair of longitudinal purlin support members aligned lengthwise along each side of the unit attached to an inside surface of the rib members at a height above each longitudinal base member.

3. The unit of claim 2 wherein the skeletal structure further comprises a top purlin support member aligned lengthwise along each side of the unit attached to an inside surface of the rib members at an uppermost height.

4. The unit of claim 1 wherein the longitudinal base member are "L" shaped cross sectioned members and the upstanding section is one side of the "L" shape.

5. The unit of claim 4 wherein the vertical tubular members are welded to the upstanding section of the longitudinal base members positioning the open bottom proximate the other horizontal section of the longitudinal base members.

6. The unit of claim 1 wherein the vertical tubular members are welded to the upstanding section of the longitudinal base members positioning the open bottom proximate a lower horizontal section of the longitudinal base members.

7. The unit of claim 1 wherein the flexible sheet bent in an arch shape to conform against the rib members comprises a plurality of extruded thermoplastic polymer structured integral panels each comprising two face sheets spaced apart by a multiplicity of webs joining the face sheets, the webs aligned to bend over the rib members.

8. The unit of claim 1 further comprising foundation means to support the unit comprising a frame of treated wood planks attached to the longitudinal base members.

9. The unit of claim 1 wherein the holding means to attach the first edges of the flexible sheet to the skeletal frame comprises bolts through oversize holes in the flexible sheet aligned with horizontal holes through the longitudinal base members, the rib members, and the vertical tubular members.

10. The unit of claim 1 wherein the connection means to connect the end walls to two arch shaped ribs positioned proximate opposite ends of the unit comprises bolts through oversize holes in the flexible sheet aligned with holes through an upper section of the peripheral flange extending inwardly from the end wall sections and the rib members.

11. A house unit comprising two ends and a length along two sides, the unit comprising:

(A) a skeletal structure comprising: p2 (i) a pair of "L" shaped cross sectioned longitudinal base members aligned lengthwise along each side of the unit, wherein one side of the "L" shape of each longitudinal base member is upstanding along an outside lower edge of the unit and a remaining side of the "L" shape positioned horizontally extended inwardly to the unit, (ii) a multiplicity of vertical tubular members each comprising an open top and an open bottom, each vertical tubular member welded to the upstanding side of the longitudinal base members at intervals spaced apart along the length of the longitudinal base members positioning the open bottom proximate the remaining side of the longitudinal base members, wherein the vertical tubular members are spaced apart forming complementary pairs across from each other laterally positioned equidistant along the length of opposite longitudinal base members, (iii) a multiplicity of arch shaped rib members each having one end inserted in an open top of a first vertical tubular member and an opposite end inserted in an open top of a second vertical tubular member that is paired with the first vertical tubular member, (iv) a pair of longitudinal purlin support members aligned lengthwise along each side of the unit attached to an inside surface of the rib members at a height above each longitudinal base member, and (v) a top purlin support member aligned lengthwise along each side of the unit attached to an inside surface of the rib members at an uppermost height, (B) two vertical end walls each having a bottom edge and an arch shaped side and top edge, each end wall comprising:

(i) a plurality of integral composite wall sections each comprising:

(a) an outside surface facing outwardly, an inside surface facing inwardly, and a peripheral edge, and (b) a peripheral flange extending inwardly from the peripheral edge, wherein the peripheral flange comprises at least one vertical section when the composite wall section is disposed vertically, and (ii) attachment means to attach adjacent vertical sections of juxtaposed composite wall sections, (C) connection means to connect the end walls to two arch shaped ribs positioned proximate opposite ends of the unit, (D) a flexible sheet bent in an arch shape to conform against the rib members, comprising a plurality of extruded thermoplastic polymer structured integral panels each comprising two face sheets spaced apart by a multiplicity of webs joining the face sheets, the webs being aligned to bend over the rib members, wherein the flexible sheet comprises two first edges of a length proximate that of the base members and a width proximate the length of the arch shaped rib members, and (E) holding means to attach the first edges of the flexible sheet to the skeletal frame proximate opposite base members.

12. The unit of claim 11 further comprising foundation means to support the unit comprising a frame of treated wood planks attached to the longitudinal base members.

13. The unit of claim 11 wherein the holding means to attach the first edges of the flexible sheet to the skeletal frame comprises bolts through oversize holes in the flexible sheet aligned with horizontal holes through the longitudinal base members, the rib members, and the vertical tubular members.

14. The unit of claim 11 wherein the connection means to connect the end walls to two arch shaped ribs positioned proximate opposite ends of the unit comprises bolts through oversize holes in the flexible sheet aligned with holes through an upper section of the peripheral flange extending inwardly from the end wall sections and the rib members.

* * * * *